US005354352A

United States Patent [19]

Seki et al.

[11] Patent Number: 5,354,352

[45] Date of Patent: Oct. 11, 1994

[54] CONTACT MATERIAL FOR VACUUM CIRCUIT BREAKERS

[75] Inventors: Tsuneyo Seki; Tsutomu Okutomi; Atsushi Yamamoto; Mikio Okawa; Kiyofumi Otobe, all of Tokyo, Japan

[73] Assignee: Kabushiki Kaisha Toshiba, Tokyo, Japan

[21] Appl. No.: 868,114

[22] Filed: Apr. 14, 1992

[30] Foreign Application Priority Data

Jun. 21, 1991 [JP] Japan ..... 3-150558

[51] Int. Cl.[5] ..... C22C 9/00

[52] U.S. Cl. ..... 75/245; 75/247; 252/512; 252/518; 428/548

[58] Field of Search ..... 75/245, 247; 419/6, 419/9, 2, 27, 29, 38; 252/512, 518; 428/548

[56] References Cited

U.S. PATENT DOCUMENTS

| | | | |
|---|---|---|---|
| 4,008,081 | 2/1977 | Hundstad | 420/495 |
| 4,048,117 | 9/1977 | Emmerich | 252/513 |
| 4,372,783 | 2/1983 | Kato | 75/246 |
| 4,486,631 | 12/1984 | Naya et al. | 200/144 B |
| 4,723,587 | 2/1988 | Iyer et al. | 164/46 |
| 4,743,718 | 5/1988 | Santilli | 200/144 B |
| 4,830,821 | 5/1989 | Okutomi et al. | 419/25 |

FOREIGN PATENT DOCUMENTS

| | | |
|---|---|---|
| 0172411 | 2/1986 | European Pat. Off. . |
| 0172912 | 3/1986 | European Pat. Off. . |
| 0178796 | 4/1986 | European Pat. Off. . |
| 0385380 | 9/1990 | European Pat. Off. . |
| 2346179 | 6/1975 | Fed. Rep. of Germany . |
| 3829250 | 3/1990 | Fed. Rep. of Germany . |
| 2392481 | 12/1978 | France . |
| 61-96621 | 5/1986 | Japan . |
| 61-41091 | 9/1986 | Japan . |
| WO90/15424 | 12/1990 | PCT Int'l Appl. . |
| 1309197 | 3/1973 | United Kingdom . |
| 2024258 | 1/1980 | United Kingdom . |

*Primary Examiner*—Donald P. Walsh
*Assistant Examiner*—Ngoclan T. Mai
*Attorney, Agent, or Firm*—Oblon, Spivak, McClelland, Maier & Neustadt

[57] ABSTRACT

Disclosed is a contact material for vacuum circuit breakers and a manufacturing process thereof. The contact material includes a copper component, a chromium component and a bismuth component, and has a metallographic structure comprising: a first phase including the copper component and the bismuth component; and a second phase including the chromium component and interposed among the first phase. In this structure, the boundary surface between the first phase and the second phase appears in a structural cross section of the alloy composition as a substantially smooth boundary line, such that when a segment of the boundary line is defined by two arbitrary points which lie on the boundary line at a straight distance of 10 μm, the ratio of the length of the segment to the straight distance of 10 μm lies within a range of approximately 1.0 to 1.4. Moreover, the boundary line may be approximate to a circle such that the ratio of the length of the boundary line to the length of the circumference of an ideal circle having the same area as the area defined by the boundary line lies within a range of approximately 1.0 to 1.3.

In the above contact material, the chromium component is preferably included at a content of approximately 20 % to 60% by weight, and the ratio of the bismuth component to the sum of the bismuth component and the copper component preferably lies within a range of approximately 0.05% to 1.0% by weight.

3 Claims, 2 Drawing Sheets

CONTACT MATERIAL FOR VACUUM CIRCUIT BREAKERS

BACKGROUND OF THE INVENTION

1. Field of the Invention

The present Invention relates to a contact material for vacuum circuit breakers, and in particular to a contact material in which weld resistance and voltage sustaining property are improved.

2. Description of the Prior Art

Contact materials for vacuum circuit breakers are basically required to have excellent material characteristics such as weld resistance, an ability to withstand preset voltage levels when contacts are in contact with each other, and an ability to completely prevent current from leaking across the contacts when the circuit is broken. It is further required that the temperature increase while making contact be small and that the contact resistance be stable at a low level. However, because some of these requirements run contrary to each other, it is difficult to meet all of the requirements by using a simple metal. Consequently, in most contact materials, two or more elements are combined in order to make up for the deficient properties of each individual element. In this way, the material characteristics are improved so that the contact material can be adapted for use in special conditions, such as heavy-currents, high-voltages and the like. Thus, these improved materials are superior to single-element materials. Up to now, however, a contact material with sufficient properties has not yet been found for handling recent trends which require the contacts to sustain heavier currents and higher voltages.

An example of a prior art contact material directed to heavy-current use is disclosed by Japanese Patent Publication No. S41-12131, in which a copper-bismuth alloy material includes a bismuth component as a weld inhibitor at a content of less than 5% by weight. However, in this Cu—Bi alloy material, the exceedingly low solubility of the Bi component in the Cu parent phase often gives rise to segregation of the Bi component In the alloy. As a result, the Cu—Bi alloy material has problems in that the contacting surfaces of the contacts made from this alloy become very rough quite easily, and it is difficult to shape and machine this alloy into contact parts.

On the other hand, another contact material for heavy-current use is disclosed in Japanese Patent publication No. S44-23751 in which a copper-tellurium alloy material is utilized. This alloy is free from the above-mentioned problems existing for the Cu—Bi alloy material, but, in comparison with the Cu—Bi alloy material, the Cu—Te alloy is more sensitive to the surrounding atmosphere, and the stability of the contact resistance is insufficient, etc.

Moreover, it has been discovered that the above-described Cu—Te and Cu—Bi alloy contact materials are equally unsatisfactory for adaptation to high-voltage, despite the fact that they have excellent weld resistant properties. In addition to that, their voltage withstanding properties are only sufficient for use at medium voltage levels.

As another contact material for a vacuum circuit breaker, a copper-chromium alloy material is known in the prior art. In this alloy material, the thermal characteristics of the Cr and Cu components are exhibited at a high temperature in a preferred manner for the contact material, and the properties of this alloy material are accordingly suitable for high-voltage and heavy-current use. Therefore, the Cu—Cr alloy material has been in widespread use because as it satisfies the requirements of both a high-voltage withstanding property and a large breaking capacity.

However, in regard to weld resistance, the above Cu—Cr alloy material is extremely inferior to the aforementioned Cu—Bi alloy material having a Bi component of less than 5%.

Here, referring to the welding phenomenon, it is considered that there are two occasions in which such phenomenon arises on the contacts. The first occasion is when the contact material resolidifies after belong melted at the contacting surfaces by Joule heat produced thereon. The second occasion is when the contact material is vaporized by arcing between the contacts at the moment when contact is being established or broken. On either occasion, the Cu and Cr components in the above-described Cu—Cr alloy material produce fine grains having a size of less than 1 μm, which randomly mix with each other and form a layer having a thickness of a few μm to a few hundred μm.

Generally, the refining of material structures leads to increased material strength, and since the above Cu—Cr alloy material is not an exception, the strength of the fine-grain layer increases. As a result, if the strength of the refined Cu—Cr layer is greater than that of the matrix phase in the Cu—Cr alloy, and if the strength of the matrix phase exceeds the value of the mechanical power designed to be supplied to the contacts by an operating mechanism for breaking contact, then the welding phenomenon arises.

Therefore, in circuit breakers using the Cu—Cr alloy contact material, the operating mechanism must be designed so that a higher mechanical power is supplied for breaking contact than in the case of using a Cu—Bi alloy material. However, this is difficult in view of the needs of compactification and economy in the circuit breakers.

In response to the above problem, a copper-chromium-bismuth contact material has been proposed in Japanese Patent Publication No. 61-41091, which discloses a Cu—Cr alloy having an added Bi component for improving the weld resistance. This Improved material has better weld resistance, but becomes severely brittle due to the addition of the Bi component. Moreover, the voltage-withstanding property decreases and the restriking frequency increases.

Consequently, contact materials that are able to satisfy the various requirements mentioned above have not been provided by the prior art.

SUMMARY OF THE INVENTION

With these problems in mind, it is therefore an object of the present invention to provide a contact material for vacuum circuit breakers that will not suffer a decrease in its ability to withstand high voltage levels and prevent increases in the restriking frequency while maintaining its weld resistant property, and a manufacturing process of such a contact material.

In order to achieve the above-mentioned object, a contact material for a vacuum circuit breaker according to the present invention includes a copper component, a chromium component and a bismuth component, and has a metallographic structure comprising: a first phase including the copper component and the bismuth component; and a second phase including the chromium component and interposed among the first phase so as to have a boundary surface between the first phase and the second phase, the boundary surface appearing in a structural cross section of the alloy composition as a substantially smooth boundary line, such that when a segment of the boundary line is defined by two arbitrary points which lie on the boundary line at a straight distance of 10 μm, the ratio of the length of the segment to the straight distance of 10 μm lies within a range of approximately 1.0 to 1.4.

The boundary surface appearing in a structural cross section of the alloy composition may be further approximate to a circle so that the ratio of the length of the boundary line to the length of the circumference of an ideal circle having the same area as the area defined by the boundary line lies within a range of approximately 1.0 to 1.3.

Moreover, a process for manufacturing an alloy material including a copper component, a chromium component and a bismuth component comprises the steps of: (A) preparing an alloy composition from a raw material for the copper component, the bismuth component and the chromium component through metallurgical treatment such that the alloy composition has a metallographic structure comprising a first phase including the copper component and the bismuth component and a second phase including the chromium component and interposed among the first phase; and (B) treating the chromium component so that the chromium component are bordered with a substantially smooth surface thereof.

The contact material may preferably include the chromium component at the content of approximately 20% to 60% by weight.

Moreover, the contact material may preferably include the bismuth component so that the ratio of the bismuth component to the sum of the bismuth component and the copper component lies within a range of approximately 0.05% to 1.0% by weight.

According to the above construction, the voltage withstanding property and the ability to prevent current leakage of the Cu—Cr—Bi alloy composition can be improved, and at the same time, a prominent weld resistant property can be imparted to the material.

BRIEF DESCRIPTION OF THE DRAWINGS

The features and advantages of the contact material according to the present invention over the prior art materials will be more clearly understood from the following description of the preferred embodiments of the present invention taken in conjunction with the accompanying drawings in which like reference numerals designate the same or similar elements or sections throughout the figures thereof and in which:

FIG. 3(*b*) is a comparative illustration for explaining the continuity of a boundary face in the metallographic structure.

DETAILED DESCRIPTION OF THE PREFERRED EMBODIMENTS

Figure 1:
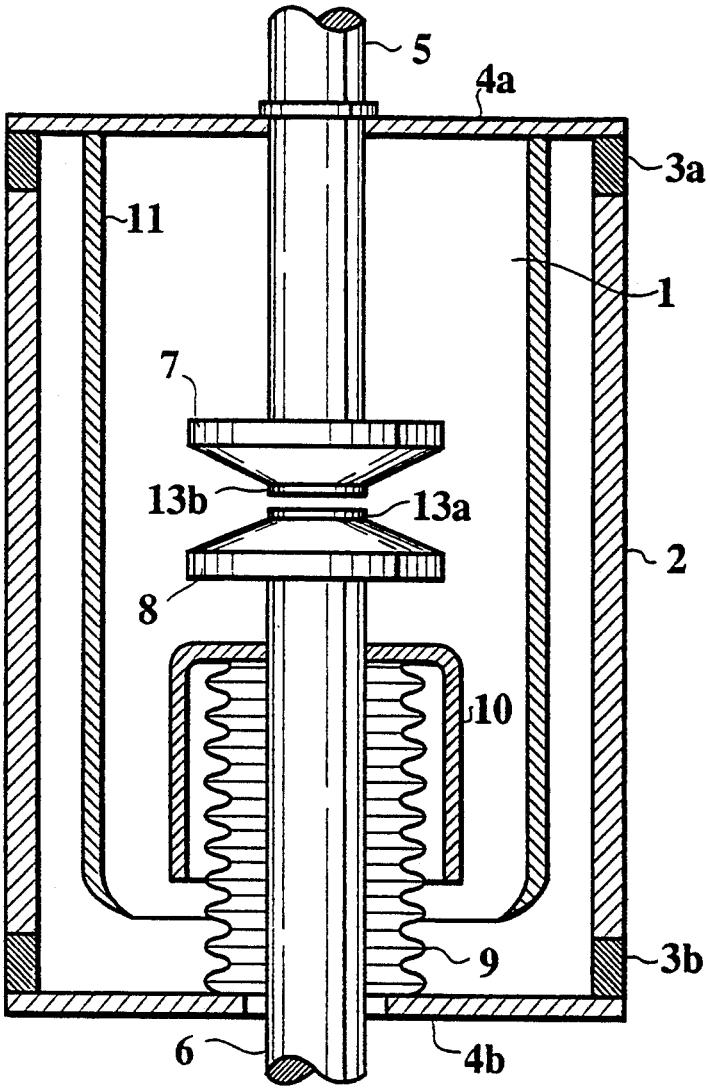
FIG. 1 is a longitudinal, sectional view showing an example of a vacuum circuit breaker to which a contact material according to the present invention is adapted.

With regards to the occurrence of the restriking phenomenon, there still remain many factors which have not yet been made clear, and various hypotheses, such as the fine grain theory, the field emission theory and the like, have been suggested with respect to the restriking mechanism. Specifically, they demonstrate that two factors responsible for the restriking phenomenon are microscopical unevenness of the contact surfaces and the existence of fine grains.

In a Cu—Cr—Bi contact material, the Bi component can be classified according to the four ways in which it exists in the alloy. That is, the first type in which it is dissolved in the Cu matrix phase, the second type in which it lies in the boundary faces between the Cr grains and the Cu matrix, the third type in which it lies in the grain boundary of the Cu matrix, and the fourth type in which it is precipitated in the crystalline grains of the Cu matrix. Initially, in order to prevent the strength of the base material from decreasing and to lessen the restriking frequency according to the above theories, an attempt was made to increase the size of the crystalline grains of the Cu matrix. However, this has not yet had any satisfactory effect, and actually only had a marginal effect.

According to further research by the inventors of the present invention, it is known that, in the case where a slight welding is generated on a contact surface resulting in a locally uneven surface, the voltage withstanding property and the restriking frequency of the contacts thereafter depend on the metallographic shapes of the Cr grains in the contact material.

Namely, the way in which the boundary face between the Cr grains and the Cu matrix lies is an important factor in the improvement of the Cu—Cr—Bi material. As mentioned above, since a part of the Bi component lies between the Cr grains and the Cu matrix, the Cr grains tend to easily fall out of the Cu matrix, which causes the contact surfaces to become uneven. It is highly possible that a Cr grain which falls off one contact surface to attach to another contact surface causes a field emission, and it appears from the inventors' study that a material containing remarkably rugged Cr grains has a lower ability to withstand voltage and a higher restriking frequency than a material containing smooth Cr grains.

As mentioned above, it is clear that the voltage withstanding property and the restriking frequency of the contact material change according to the shape of the Cr grains, but the exact nature of the change has yet to be completely understood. More specifically, the voltage withstanding property and the restriking frequency of the Cu—Cr—Bi contact material can reach the same levels as provided by conventional Cu—Cr contact materials, in accordance with the sphericality or nonprotrusion of the Cr grain surface and the continuity or smoothness of the boundary faces between the Cu and Cr components.

Referring now to the drawings, preferred embodiments of the contact material according to the present invention will be described.

First, a vacuum circuit breaker to which the contact material according to the present invention can be applied will be explained with reference to FIGS. 1 and 2.

Figure 2:
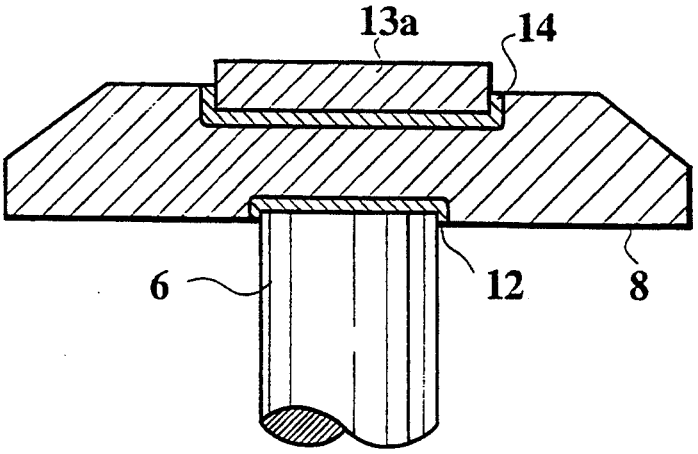
FIG. 2 is an enlarged sectional view showing a contact part incorporated in the circuit breaker shown in FIG. 1.

As shown in FIG. 1, a breaker chamber 1 is constructed with an insulating casing 2 and lid members 4*a* and 4*b*. The insulating casing 2 is formed into an almost cylindrical shape with an insulating material, and the lid members 4*a* and 4*b* are arranged on both ends of the insulating casing 2 via sealing metal members 3*a* and 3*b*, so that the inside of the insulating casing 2 is maintained as an airtight vacuum. In the breaker chamber 1, electrically conductive bars 5 and 6 are aligned in such a way that their respective ends which lie inside the case are positioned to face each other. A pair of electrodes 7 and 8 are arranged on each of the aligned ends of the bars. The upper electrode 7 corresponds to a fixed electrode, and the lower electrode 8 to a movable electrode. The movable electrode 8 is equipped with bellows 9 so that the movable electrode 8 can be axially moved while maintaining the airtight vacuum in the breaker chamber 1. On the bellows 9, a metal arc shield 10 is provided so as to prevent the bellows from being covered with arcing metal vapor. Moreover, a metal arc shield 11 is provided in the breaker chamber 1 so as to cover the electrodes 7 and 8. This arc shield 11 can prevent the arcing metal vapor from covering the insulating casing 2. As shown in FIG. 2, which is an enlarged view of a contact part, the electrode 8 is fixed to a soldering portion 12 of the conductive bar 6 with solder. Alternatively, the electrode 8 may be jointed to the conductive bar 6 by caulking the portion 12 with the electrode 8. A contact 13*a* is fixed on the electrode 8 with solder 14. Similarly, a contact 13*b* is attached on the fixed electrode 7.

The contact material according to the present invention is suitable for either of the above-mentioned contacts 13*a* and 13*b*.

Next, a method of manufacturing the contact material according to the present invention will be explained.

The contact material of the present invention is characterized by the form of Cr grains contained therein. Thus the particle shape of the raw Cr material powder used for manufacturing the contact material is one of the most important aspects of the present invention. For this reason, an ordinal process for preparing the raw Cr material powder will be mentioned below.

Generally, the raw Cr material powder is obtained first in the form of a coarse Cr powder by using a reduction process, an electrolytic method or the like. It is then pulverized in order to create a raw Cr material powder having a preferred particle size. As a result, the particles become rugged and angular.

This raw Cr material powder can be smoothened by subjecting it to a chemical treatment such as a corrosion treatment with an acid agent such as a hydrochloric acid having an appropriate concentration or a heat treatment such that the powder particles can be transfigured. Such a smoothened Cr powder is to be used for manufacturing the contact material according to the present invention. Even without being subjected to those pre-treatment, the rough raw Cr material powder can be used for manufacturing the contact material if an infiltration method is employed during the manufacturing process, which will be described in detail below.

The manufacturing method of the Cu—Cr—Bi contact material according to the present invention is generally classified into two types. One is an infiltration method, and the other is a solid-phase sintering method. A preferred embodiment according to each method will be described below, respectively.

In the infiltration method, a Cr powder having a preferred particle size is first pressed to obtain a Cr compact. Then, the Cr compact is pre-sintered at a predetermined temperature, for example, at 950° C. for one hour in a hydrogen atmosphere having a dew point equal to or less than −50° C. or under a reduced pressure of $1\times10_{-3}$ tort or less, thereby obtaining a pre-sintered Cr compact. Next, either a Cu—Bi alloy or a compact of pressed Cu and Bi powders, containing a required amount of Bi component, is fused and infiltrated into pores remaining in the pre-sintered Cr compact. If a raw Cr material powder of the angular type was employed for the first step, the angular shape of the Cr powder particles of the compact can be made smooth and round at this Cu—Bi infiltration step by means of holding the Cr compact for a necessary period at a temperature such that the Cu component can be made molten. Here, it is to be noted that the infiltration may also be performed either in a hydrogen atmosphere or under a reduced pressure.

In the solid-phase sintering method, the raw Cr material powder is mixed with a Cu powder and a Bi powder at a predetermined ratio, and the mixed powder is then pressed using a compacting machine to make a Cu—Cr—Bi compact. The compact is sintered in a hydrogen atmosphere having a dew point of equal to or less than −50° C. or under a reduced pressure of $1\times10_{-3}$ torr or less. The sintered compact is repressed and sintered again, and this process of repressing and sintering is repeated a few times until the desired Cu—Cr—Bi contact material is obtained.

Here, it should be noted that the method of smoothing the Cr powder particles is not limited to the above-mentioned manners. The rugged Cr powder particles may be, of course, transfigured suitably by means of regulation of the heating temperature such that the powder particles can be transfigured during sintering of the Cu—Cr—Bi compact.

The final contact material contains nearly spherical Cr grains, and when the material is actually used for contacts, it can maintain a voltage withstanding property on a level with a Cu—Cr contact material including no Bi component.

EXAMPLES

Now, relationships between the metallographic structure and the material properties of the contact material according to the present invention will be described in detail in accordance with examples and a comparative example which are shown in Tables 1 and 2. The method and test conditions for measurement of each material property are as follows:

(1) Weld Resistant Property

On a disk-type test sample having a diameter of 25 mmΦ, a pressure rod having a diameter of 25 mmΦ and a spherical tip surface curved at a curvature radius of 100 R with its spherical surface facing the circular surface of the sample were pressed at a load of 100 kg under a reduced pressure of $10^{-5}$ mmHg. In this state, a 20 KA electric current of 50 Hz was applied to the rod and the sample, and then the mechanical force necessary to break contact between the rod and the sample disk after applying the current for 20 msec was measured. From this result, the relative value of the necessary breaking force of the sample to that of the sample in Comparative Example 1 was calculated, wherein the relative value of Comparative Example 1 is by definition equal to 1. In Comparative Example 1, the sample was manufactured by using the solid-phase sintering method, which Is hereinafter described in detail. With respect to each example, three samples were subjected to measurements, and a distribution range of the three relative values is shown in the weld resistant property columns of Table 1 and Table 2 for evaluating the weld resistant property of the sample material.

(2) Voltage Withstanding Property

To prepare an anode, a needle made of nickel was mirror-finished by buffing. A sample material was also buffed in the same way to obtain a mirror-finished cathode needle. The anode and cathode needles, aligned to point with each other, were set at a distance of 0.5 mm under a reduced pressure of $10^{-6}$ mmHg, and a gradually increasing voltage was then applied. The voltage being applied to the needles at the moment a spark was produced between them, corresponding to a static withstanding voltage, was measured. Then, the relative value of the measured voltage of the sample to that of the sample in the Comparative Example 1 was calculated, wherein the relative value of Comparative Example 1 is by definition equal to 1. The measurement was repeated three times for each example, with the mean value of the three relative values being listed in the static withstanding voltage columns of Table 1 and Table 2 for evaluating the voltage withstanding property of the sample material being tested.

(3) Restriking Frequency

A pair of disk-type sample contact pieces, with each piece having a diameter of 30 mm and a thickness of 5 mm, were attached to electrodes of a demountable vacuum circuit breaker by baking them at a temperature of 450° C. for 30 minutes. It should be noted here that the installment of the sample pieces was not accompanied by use of solder nor heat for soldering. The circuit breaker was then connected to a circuit of 6 KV×500 A. In this state, the contact was broken repeatedly, 2,000 times, during which the restriking frequency was calculated by counting the number of times restriking took place. Using two different sets of vacuum circuit breakers, six pairs of sample pieces were subjected to the breaking test for each example. A distribution range of the six values of restriking frequency is shown in the restriking frequency columns of Table 1 and Table 2.

(4) Specific Circumference and Continuity (Smoothness) of Cu/Cr boundary surfaces In the cross sectional structure of the contact material for each example, the actual circumferences of the Cr grains were measured and compared with those of ideal circles having the same surface areas that the Cr grains have. The mean values of ratios of the actual circumferences relative to those of the ideal circles is defined as a specific circumference and are shown in Table 1 and Table 2. Here, it is to be noted that the value of the specific circumference of the actual circumference approaches 1 the closer the shape is to that of a circle, or that according as the specific circumference grows larger than 1, the actual circumference looses its circularity.

Figure 3A:
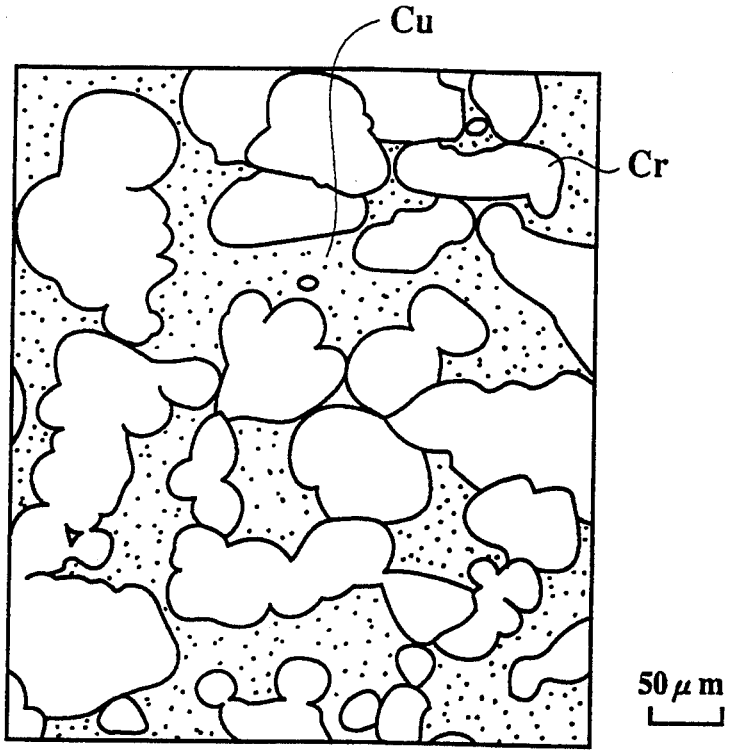
FIG. 3(*a*) is an illustration showing a typical metallographic structure of the contact material according to the present invention.
Figure 3B:
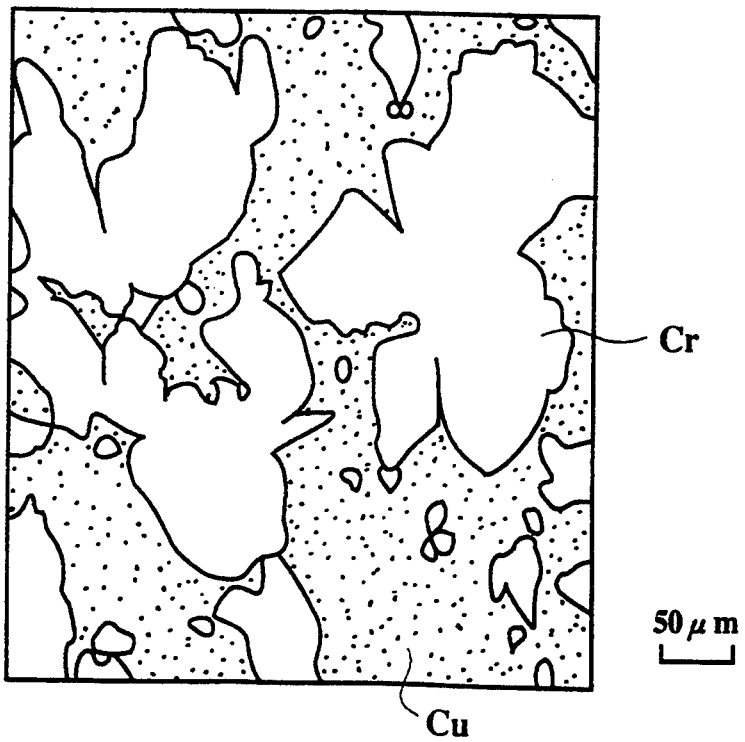

Continuity or smoothness of the boundary surfaces between the Cr grains and the Cu matrix phase can be explained with reference to FIGS. 3(*a*) and 3(*b*). An illustrative example of the cross sectional structure in which the Cu/Cr boundary surfaces are regarded to be continuous is shown in FIG. 3(*a*), while, on the other hand, FIG. 3(*b*) shows an illustration of a structure having discontinuous boundary surfaces. As clearly shown in the drawings, the Cr grains of FIG. 3(*a*) are surrounded by almost smooth or continuous curves bordering the Cu matrix phase, and there are substantially few distinctly angular or sharp portions. In such a condition, the ratio of the length of a boundary line segment between two arbitrary points which lie on the boundary line at a straight distance of 10 μm relative to the straight distance of 10 μm can be measured as being almost within a range of 1.0 to 1.4. Therefore, in the present invention, if the boundary surface has substantially no angularity in an enlarged view of the metallographic structure at a magnification of approximately 200, or if the ratio of the boundary line segment length to the straight distance is within the above-described range, such a boundary surface can be regarded as being substantially continuous and smooth. In contrast to this, the boundary lines between the Cr grains and the Cu matrix phase in FIG. 3(*b*) have many angular and sharp portions. In such a case, the boundary surface is regarded as being discontinuous.

Comparative Example 1

Using an angular type of raw Cr material powder not having been subjected to chemical treatment, a conventional Cu—Cr contact material was manufactured by the solid-state sintering method, and the above-described material properties of the obtained Cu—Cr material were measured. The measured values with respect to weld resistant property and static withstanding voltage which are listed in Table 1 were utilized as a standard value for evaluating the data in the following examples.

Comparative Examples 2 and 3 and Example 1 to 4

The Cu—Cr—Bi contact material for each of Comparative Examples 2 and 3 and Example 1 was manufactured in a similar manner as described for Comparative Example 1 by varying the parameters of shapes of the raw Cr material powder. The shapes and specific circumference values of the obtained Cr grains in the cross sectional structure, the continuity of the Cu/Cr boundary surfaces, and the results of measurements of material properties are shown in Table 1. As shown in the results of Comparative Examples 2 and 3, if the Cr grains contained in the contact material have angular shapes and the Cu/Cr boundary surfaces are discontinuous, the static withstanding voltage tends to decrease and the restriking frequency tends to increase irrespective of the value of specific circumference. On the other hand, if spherical raw Cr material powder or the like is used giving the Cr grains a round shape as shown in Example 1, improved static withstanding voltage and restriking frequency is achieved.

The samples of Examples 2 to 4 are Cu—Cr—Bi contact materials manufactured by the infiltration method. As shown in the results of Example 2, if a Cr powder having a distinctly large specific circumference is used as a raw material to obtain thereby a contact material including Cr grains having a large specific circumference, the static withstanding voltage decreases and the restriking frequency increases. Conversely, when the specific circumference of the Cr grains is about 1.1 to 1.2, which is more approximate to that of a circle, and when the Cu/Cr boundary surface is continuous as shown in Examples 1, 3, and 4, satisfactory results can be obtained with respect to static withstanding voltage and restriking frequency irrespective of the manufacturing method.

Consequently, when the electrical material properties of Cu—Cr—Bi contact materials are to be evaluated, it is best to take into consideration the shapes of the raw Cr material powder, the manufacturing method, the shapes of the Cr grains in the contact material structure, the specific circumferences of the Cr grains, and the continuity of the Cu/Cr boundary surfaces. Having used this approach, it was discovered that more beneficial results can be achieved by controlling the Cr grains in the structure of the obtained contact material in such a way as to limit the specific circumference of the Cr grains to lie within the range of 1.3 or less, while providing smooth and continuous boundary surfaces.

Examples 5 to 8

In order to assure the existence of a preferred amount of Cr component in Examples 5 through 8 and in the former Example 3, the Cr content in the contact material was parameterized by regulating the ratio of Bi/(Bi+Cu) to a roughly constant level. In particular, a Cr component was added to the manufactured contact materials of Example 5 to 8 and Example 3 at a content of 10.3 wt %, 21.0 wt %, 59.0 wt %, 70.1 wt % and 48.1 wt %, respectively. In terms of their material properties, all of these materials were prominent in weld resistance, as shown in Table 2. In contrast, the withstanding voltage of the contact material of Example 5, which contains 10.3 wt % Cr component, deteriorated because of an excess amount of Cu component, though the value of the restriking frequency was sufficient. In Example 8, in which the obtained material contains 70.1 wt % Cr component, the contact material was more brittle because of an excess amount of Cr component, and the results of the voltage withstanding property and restriking frequency were not exceptionally good. On the other hand, from the other contacts of Examples 3, 6 and 7, satisfactory results could be obtained with regard to both voltage withstanding property and restriking frequency.

As a result, the preferable Cr content was determined to lie within the range of approximately 20 wt % to 60 wt %.

Examples 9 to 12

In Examples 9 to 12 and in the former Example 3 as shown in Table 2, the value of the ratio Bi/(Bi+Cu) was varied as a parameter so that the manufactured contact materials contained a Bi component at a Bi/(Bi+Cu) ratio of 0.01 wt %, 0.05 wt %, 0.98 wt %, 5.3 wt % and 0.45 wt %, respectively, while the Cr content was regulated at a constant level of about 50 wt %. Materials containing a lesser amount of Bi component, such as in Example 9, performed excellently with regards to voltage withstanding property and restriking frequency, but had hardly any improvement with regards to weld resistance in comparison with the material of Comparative Example 1, which did not include a Bi component. On the other hand, in materials containing a greater amount of Bi component, such as in Example 12, the voltage withstanding property deteriorated remarkably and the restriking frequency increased dramatically. However, the contacts of Examples 10, 11 and 3 which contained a Bi component at a Bi/(Bi+Cu) ratio of 0.05 wt %, 0.98 wt % and 0.45 wt %, respectively, preferred results could be obtained with regards to weld resistant property, the voltage withstanding property and restriking frequency.

Consequently, a preferable Bi/(Bi+Cu) ratio was determined to lie within the range of approximately 0.05 wt % to 1.0 wt %.

In the above description of the preferred embodiments, the contact materials were manufactured by using a solid-state sintering method or an infiltration method. However, it must be clearly understood that the same contact material as that according to the present invention can also be obtained by the use of other manufacturing methods, with substantially the same results being achieved.

Therefore, it must be understood that the invention is in no way limited to the above embodiments and that many changes may be brought about therein without departing from the scope of the invention as defined by the appended claims.

TABLE 1

| | | | | | Cross Sectional Structure of Contact Material | | | Results of Measuring Material Properties | | |
|---|---|---|---|---|---|---|---|---|---|---|
| | Cr (wt %) | Bi/ Cu + Bi (wt %) | Shape of Raw Cr Powder | Manufacturing Method | Shape of Cr Grain | Specifc Circumference | Boundary Surface Between Cu and Cr | Weld Resistant Property | Static Withstanding Voltage | Restriking Frequency |
| Comparative Example 1 | 50.3 | — | angular | solid-phase | angular | 1.3 | discontinuous | 1.0 | 1.0 | 0.05-0.1 |
| Comparative Example 2 | 49.8 | 0.52 | angular | solid-phase | angular | 1.3 | discontinuous | 0.3-0.4 | 0.7 | 0.3-0.4 |
| Comparative Example 3 | 48.1 | 0.47 | angular | solid-phase | angular | 1.6 | discontinuous | 0.3-0.4 | 0.6 | 0.4-0.5 |
| Example 1 | 49.3 | 0.45 | circular | solid-phase | circular | 1.2 | continuous | 0.3-0.4 | 0.8 | 0.2-0.3 |
| Example 2 | 47.2 | 0.41 | angular | infiltration | circular | 1.6 | continuous | 0.3-0.4 | 0.7 | 0.3-0.4 |
| Example 3 | 48.1 | 0.45 | angular | infiltration | circular | 1.2 | continuous | 0.3-0.4 | 0.9 | .01-0.2 |
| Example 4 | 51.1 | 0.45 | circular | infiltration | circular | 1.1 | continuous | 0.3-0.4 | 0.8 | 0.2-0.3 |

TABLE 2

| | Cr (wt %) | Bi/ Cu + Bi (wt %) | Shape of Raw Cr Powder | Manufacturing Method | Cross Sectional Structure of Contact Material: Shape of Cr Grain | Specifc Circumference | Boundary Surface Between Cu and Cr | Results of Measuring Material Properties: Weld Resistant Property | Static Withstanding Voltage | Restriking Frequency |
|---|---|---|---|---|---|---|---|---|---|---|
| Example 5 | 10.3 | 0.39 | circular | solid-phase | circular | 1.3 | continuous | 0.3–0.4 | 0.6 | 0.1–0.2 |
| Example 6 | 21.0 | 0.45 | circular | solid-phase | circular | 1.3 | continuous | 0.3–0.4 | 0.9 | 0.1–0.2 |
| (Example 3) | 48.1 | 0.45 | angular | infiltration | circular | 1.2 | continuous | 0.3–0.4 | 0.9 | 0.1–0.2 |
| Example 7 | 59.0 | 0.43 | angular | infiltration | circular | 1.2 | continuous | 0.3–0.4 | 0.9 | 0.1–0.2 |
| Example 8 | 70.1 | 0.47 | angular | infiltration | circular | 1.2 | continuous | 0.2–0.3 | 0.7 | 0.8–1.6 |
| Example 9 | 50.6 | 0.01 | angular | infiltration | circular | 1.2 | continuous | 0.95–1.0 | 1.0 | 0.05–0.1 |
| Example 10 | 47.7 | 0.05 | angular | infiltration | circular | 1.2 | continuous | 0.6–0.7 | 0.95 | 0.05–0.1 |
| (Example 3) | 48.1 | 0.45 | angular | infiltration | circular | 1.2 | continuous | 0.3–0.4 | 0.9 | 0.1–0.2 |
| Example 11 | 48.1 | 0.98 | angular | infiltration | circular | 1.2 | continuous | 0.3–0.3 | 0.9 | 0.1–0.3 |
| Example 12 | 46.2 | 5.3 | angular | infiltration | circular | 1.2 | continuous | 0.2–0.3 | 0.6 | 0.8–1.6 |

What is claimed is:

1. An alloy composition including a copper component, a chromium component and a bismuth component, and having a metallographic structure comprising:

a first phase including said copper component and said bismuth component; and a second phase including said chromium component and interposed among said first phase so as to have a boundary surface between said first phase and said second phase, said boundary surface appearing in a structural cross section of said alloy composition as a substantially smooth boundary line, such that when a segment of said boundary line is defined by two arbitrary points which lie on said boundary line at a straight distance of 10 μm, the ratio of the length of said segment to said straight distance of 10 μm lies within a range of approximately 1.0 to 1.4.

wherein the amount of said bismuth component divided by the sum of the amounts of said bismuth component and said copper component, lies within a range of approximately 0.05% to 1.0% by weight.

2. The alloy composition of claim 1, wherein the substantially smooth boundary line is further approximating a circle such that the ratio of the length of the boundary line to the length of the circumference of an ideal circle having the same area as the area defined by the boundary line lies within a range of approximately 1.0 to 1.3.

3. The alloy composition of claim 1, wherein the chromium component is included at a content of approximately 20% to 60% by weight.

* * * * *